United States Patent [19]

Lems et al.

[11] Patent Number: 4,665,552

[45] Date of Patent: May 12, 1987

[54] ZIPPER EQUIPPED BAGS AND METHOD OF AND MEANS FOR MANUALLY FILLING AND SEPARATING THEM

[75] Inventors: Peter Lems, Wilmette, Ill.; Steven Ausnit, New York City, N.Y.; Robert S. Nocek, Stamford, Conn.

[73] Assignee: Minigrip, Inc., Orangeburg, N.Y.

[21] Appl. No.: 746,079

[22] Filed: Jun. 18, 1985

[51] Int. Cl.[4] ..... B65D 30/00

[52] U.S. Cl. ..... 383/37; 383/63; 383/65; 53/384; 53/469; 53/570

[58] Field of Search ..... 53/381 R, 381 A, 469, 53/384, 570, 468; 383/13, 6, 22, 97, 37, 63, 65; 493/230, 238

[56] References Cited

U.S. PATENT DOCUMENTS

| | | | |
|---|---|---|---|
| 3,346,883 | 10/1967 | Ersek | 383/6 X |
| 3,618,286 | 11/1971 | Membrino | 53/384 X |
| 3,699,746 | 10/1972 | Titchenal et al. | 53/384 X |
| 3,744,211 | 7/1973 | Titchenal et al. | 53/384 X |
| 3,746,057 | 7/1973 | Titchenal | 53/384 X |
| 3,941,306 | 3/1976 | Weikert | 383/6 X |
| 4,169,345 | 10/1979 | Douwega | 53/384 X |
| 4,490,959 | 1/1985 | Lems | 53/459 |
| 4,514,962 | 5/1985 | Ausnit | 53/384 X |
| 4,541,117 | 9/1985 | Ashbeck | 383/13 X |

FOREIGN PATENT DOCUMENTS

| | | |
|---|---|---|
| WO82/00129 | 1/1982 | PCT Int'l Appl. . |
| WO82/02514 | 8/1982 | PCT Int'l Appl. . |
| WO84/01351 | 4/1984 | PCT Int'l Appl. . |

*Primary Examiner*—John Sipos
*Assistant Examiner*—Steven P. Weihrouch

[57] ABSTRACT

Integrally serially connected top fillable bags have closed bottoms and sides and reclosable zippers from which pull flanges extend upwardly. The bags are separated along their sides including the pull flanges and continuous connecting strips connect the tops of the pull flanges and have guide ribs extending continuously therealong for engagement by supporting jaws which serve to open the serially connected bags one at a time at a filling station for filling. After the filling station, the filled bag is separated from the connected bags by removing the connecting strip from the tops of the pull flanges of the filled bags in line with or below the top ends of the separations between bags. The zipper of the filled bag is closed by a closing device such as pinch rolls through which the bag is pulled and the connecting strips removed.

20 Claims, 12 Drawing Figures

ZIPPER EQUIPPED BAGS AND METHOD OF AND MEANS FOR MANUALLY FILLING AND SEPARATING THEM

BACKGROUND OF THE INVENTION

This invention relates to zipper equipped bags, and is more particularly concerned with such bags which are connected together in a manner that facilitates handling for manually filling and separating the bags.

Although automatic filling of zipper equipped chain bags is known, reference being had, for example, to U.S. Pat. No. 4,490,959 dated Jan. 1, 1985 issued to Peter Lems, one of the applicants herein, there has been a need for a convenient and economical arrangement for manual filling of zipper equipped bags which will avoid the need for handling of each individual bag. It is primarily to the solving of that problem that the present invention has been directed.

SUMMARY OF THE PRESENT INVENTION

Accordingly, it is an important object of the present invention to provide zipper equipped bags in a manner to facilitate manual filling of the bags.

Another object of the invention is to provide a new and improved method of manually filling zipper equipped bags.

A further object of the invention is to provide new and improved apparatus for manually filling zipper equipped bags.

The present invention provides, integrally serially connected top fillable bags wherein each bag has closed bottom and side edges and reclosable zipper means extending across the top of each bag with upstanding front and rear pull flanges extending above the zipper means, the bags being partially separated by separations along their adjacent sides and the separations extending upwardly past the zipper means and to the tops of the pull flanges. Respective continuous strips integrally connect the tops of the front and rear pull flanges of all of the bags and thereby connect the bags in continuous series. The connecting strips have guide ribs extending continuously along their upper edge portions, so that the connected bags can be slidably drawn through supporting jaws serving also as bag top filling separators. The strips are removable from the tops of the pull flanges so that the bags are separated from one another by virtue of said separations. The ends of the pull flanges of each bag may be secured together at the separations, and the secured pull flange ends remaining secured after removal of the strips.

This invention also provides a method of filling and separating top fillable serially connected bags which are closed along their bottom and sides and have reclosable zippers along their upper end portions with front and rear pull flanges extending above the zippers, the bags being partially separated from one another along their adjacent sides by separations which extend upwardly past the zippers and to the tops of the pull flanges and between the ends of the pull flanges there being respective continuous integral strips connecting the tops of the front and rear pull flanges and thereby connecting the bags to one another in series, and the upper portions of the connecting strips having continuous guide ribs therealong. The method comprises slidably engaging the ribs in supporting and separating jaw means at a filling station, relatively sliding the ribs in the jaw means and thereby moving and aligning the bags seriatim into said filling station, and as each bag is in the filling station effecting separation of the pull flanges by means of the jaw means and thereby opening the top of the bag by pulling the zipper of the bag open, filling contents into the bag, advancing the connected bags and thereby moving the filled bag away from the filling station and advancing a succeeding bag into the filling station for opening and filling, closing the zipper of the filled bag, and separating the connecting strips from the tops of the pull flanges of the filled bag and thereby separating the filled bag from the remaining connected bags.

There is also provided by the present invention apparatus for filling and separating serially connected top fillable bags which are closed along their bottom and sides and have reclosable zippers along their upper end portions with front and rear pull flanges extending above the zippers, the bags being separated from one another along their adjacent sides by separations which extend upwardly past the zippers and to the tops of the pull flanges, there being respective continuous integral strips connecting the front and rear pull flanges and thereby connecting said tops of the bags to one another, the upper portions of the connecting strips having continuous guide ribs therealong, the apparatus comprising means providing a bag filling station including supporting and separating jaws for slidably engaging the ribs for movement of said bags along said jaws and aligning the bags seriatim in the filling station. The jaws are operable for separating the pull flanges and thereby the zipper of each bag in the filling station so as to open the top of the bag between the closed ends of the pull flanges for receiving contents into the bag. The filled bag upon being moved from the filling station effects advance of a succeeding bag into the filling station for opening and filling of the succeeding bag. Means are provided for separating the connecting strips from the tops of the pull flanges of the filled bag and thereby separating the filled bag from the remaining connected bags, and for closing the zipper of the filled bag.

BRIEF DESCRIPTION OF THE DRAWINGS

Other objects, features and advantages of the invention will be readily apparent from the following description of representative embodiments thereof, taken in conjunction with the accompanying drawings, although variations and modifications may be effected without departing from the spirit and scope of the novel concepts embodied in the disclosure, and in which.

DETAILED DESCRIPTION

Figure 1:
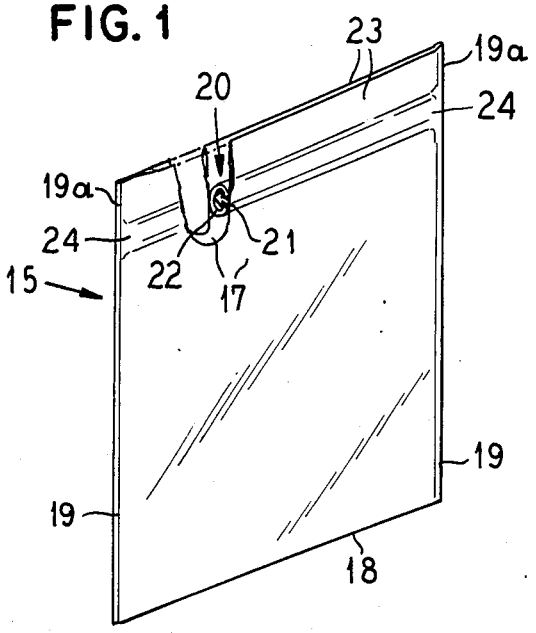
FIG. 1 is a perspective view of a zipper equipped bag produced according to the present invention.

The bags 15 (FIG. 1) is shown as an example of the type of bag which is adapted to be made according to the present invention. It is of the top filling type, commonly made from a suitable plastic film such as polyethylene. A pouch for the bag 15 is provided between wall panels 17 which are secured together along a bottom edge 18 and opposite side edges 19. As shown, the bottom edge 18 is formed by folding a film web upon itself to provide the wall panels 17. On the other hand, if preferred, the wall panels 17 may comprise separate strips which are secured together as by means of heat sealing, electronic welding, or the like. The sides 19 of the bag are secured together as by a means of heat sealing or electronic means.

Within the top portion of the bag 15 is a reclosable zipper 20. In a desirable form, the zipper 20 comprises a generally arrowhead shaped rib profile 21 which is separably interengageable within a groove-shaped profile 22. Both of the profiles 21 and 22 are resiliently flexible for readily snapping together for closing the zipper and for pull-apart separation by manipulation of front and rear pull flanges 23 which project upwardly from the zipper 20. As shown, at their opposite ends the profiles 21 and 22 are secured together by spot seals 24 aligned with the side seals 19. It will be noted that the ends of the pull flanges are also sealed together at 19*a* in line with the spot seals 24 and the side seals 19.

Figure 2:
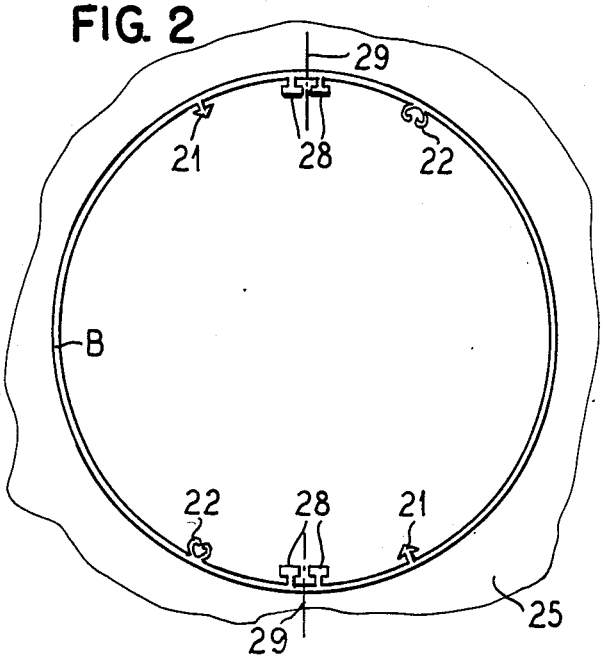
FIG. 2 is a schematic illustration of how material for producing connected zipper equipped bags is adapted to be produced by extrusion.

As represented in FIG. 2, the material for the bag 15 may be economically formed by extrusion. By means of an extrusion die 25 which has a suitably configured extrusion orifice 27 by which, in this instance, a tubular extruded plastic film blank B is adapted to be produced as a continuous tube having on its inner diameter integrally extruded therewith two sets of the profiles 21 and 22 and with the expanse of the blank B of such size as to produce two lines of bag material web with each web equipped with cooperatively related complementary zipper profiles 21 and 22.

In addition, the extruded bag making blank B has integrally extruded therewith guide ribs 28, there being a pair of the ribs 28 for each of the bag making webs of the blank B when the blank B is separated along lines 29 between the guide ribs 28. The function of the guide ribs 28 will be more particularly described hereinafter.

Figure 5:
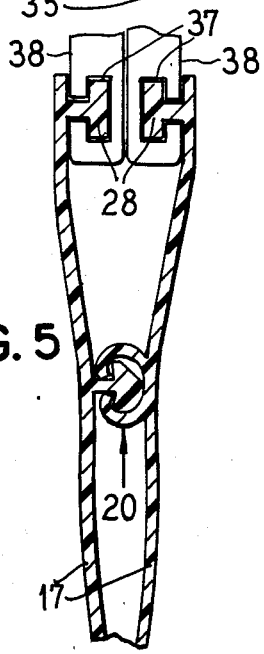
FIG. 5 shows how the bag material of FIG. 2 is adapted to be supported and guided.

In one desirable arrangement, the guide ribs 28 are of general T-shape as shown in FIG. 2 and in FIG. 5. In this instance the guide ribs 28 are located on the inner sides of the blank B or the webs to which they are attached, that is, on those portions of the web which will face one another in the bag format.

Figure 3:
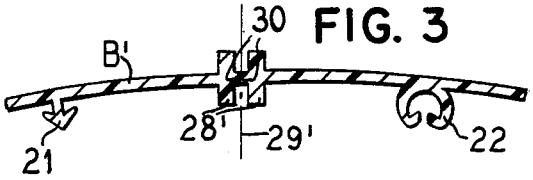
FIG. 3 shows a fragmentary portion of a modified extruded bag making material.
Figure 6:
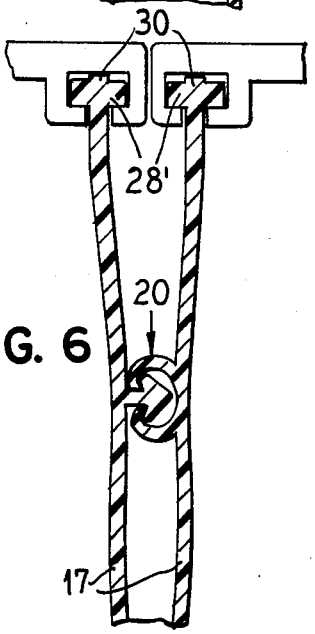
FIG. 6 shows how the bag material of FIG. 3 is adapted to be supported and guided.

In another formation of the guide ribs identified as 28′ (FIGS. 3 and 6) the guide ribs are formed at each side of the tubular extrusion, but extending lengthwise across the blank B′ so that when the web is separated along the line 29′ between the ribs 28′, the ribs 28′ will be along the top edge of the web and desirablly with a narrow crown projection spacer 30 along the upper sides of the guide ribs.

Figure 4:
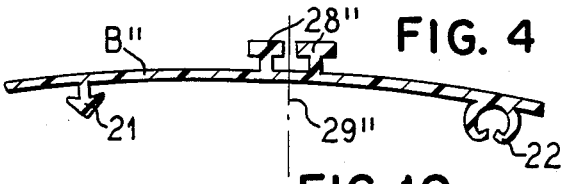
FIG. 4 shows another modification of the material.
Figure 7:
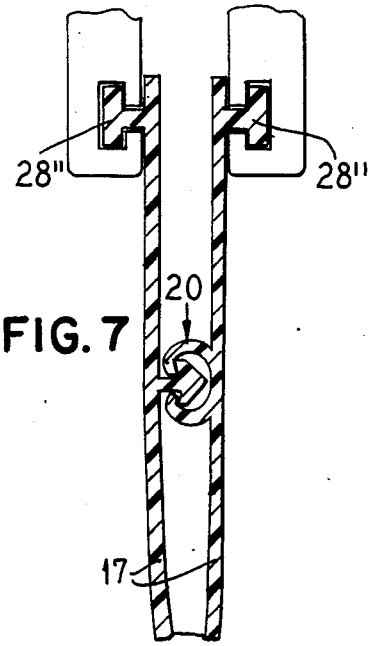
FIG. 7 shows how the bag material of FIG. 4 is adapted to be supported and guided.

In another form, ribs 28″ (FIGS. 4 and 7 may be formed along the outer side of the blank B″ so that upon separation along the line 29″ the ribs 28″ will be at the outside of the webs of blank B″.

Other forms of the guiding ribs may be found useful. For example, in FIG. 8, instead of the T-shaped rib arrangement of FIGS. 2, 4, 5 and 7, companion ribs 31 of solid rectangular form (FIG. 8 or 10) may be provided on the upper edge of the bag making web. On the other hand, the guide ribs may be as shown in FIG. 9 wherein the ribs 32 are of generally diamond shape with one of the corners of the diamond shape cross-section attached to the bag wall web.

The various forms of the guide ribs are especially useful in adapting bags made from the bag making material for hand filling of the bags in a convenient, efficient, labor saving manner.

Figure 11:
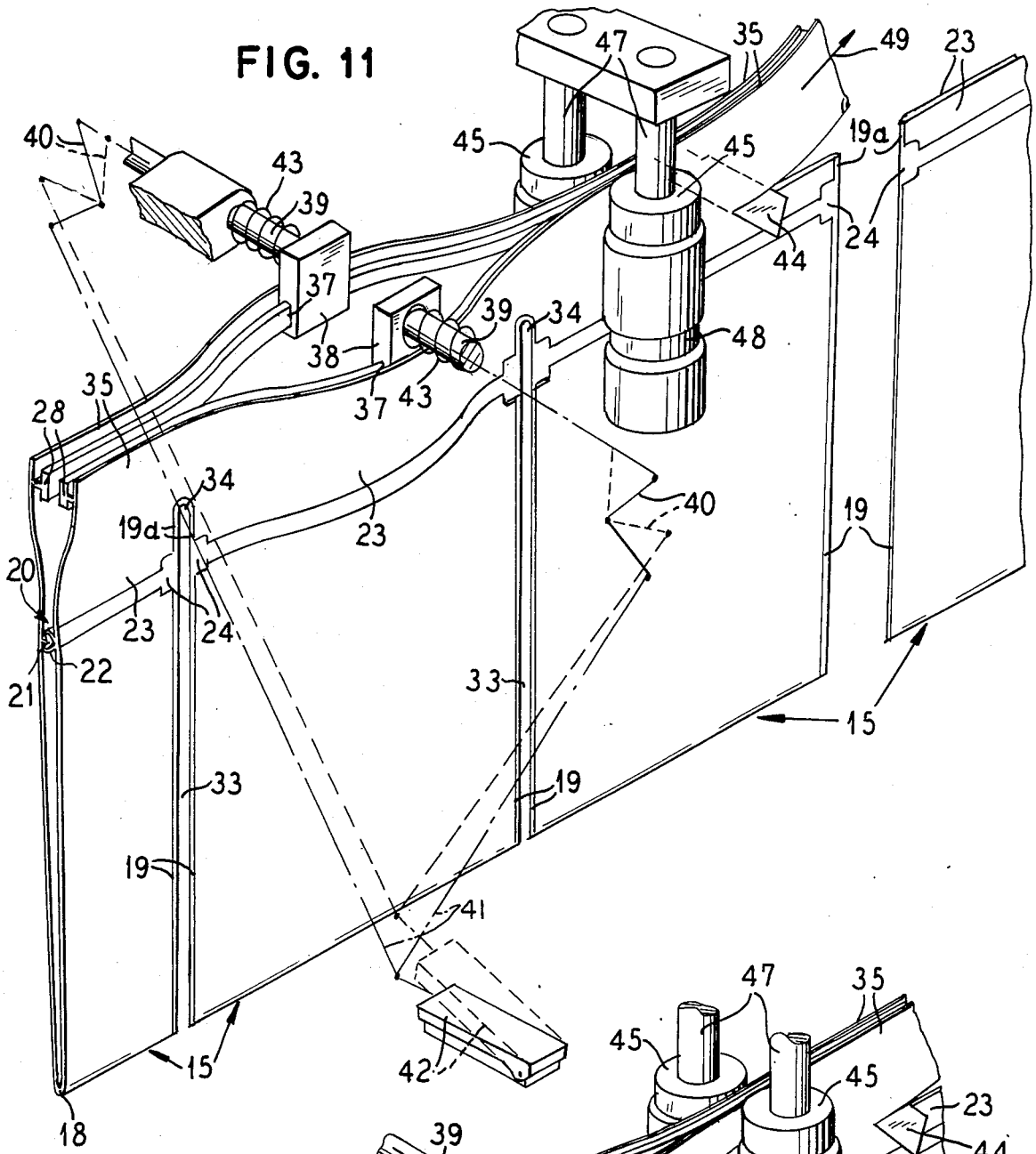
FIG. 11 is a schematic illustration of bag filling and separating apparatus with bag supporting and opening jaws in the open position.
Figure 12:
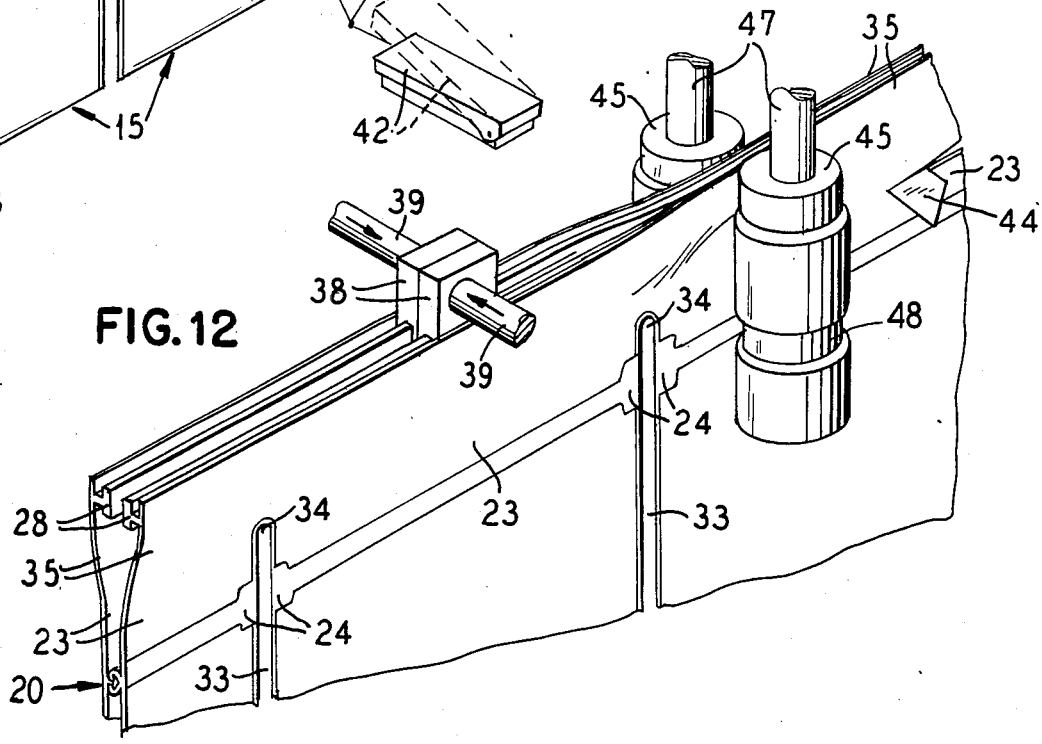
FIG. 12 shows the arrangement of FIG. 11 with the jaws closed.

A hand filling set-up is schematically illustrated in FIGS. 11 and 12. For this purpose, the extruded bag making material is formed into a continuous, connected series of the bags 15. In the series, the bags are partially separated from one another by separations 33 along and between the adjacent sealed side edges 19 of the bags. Each separation 33 extends all the way from the bottom 18 up between the spot seals 24 on the contiguous bags and to a desirable extent past and above the zippers of the bags as shown at the upward extensions of the separations 33 and 34. The length of the separation extensions 34 is equal to the desired width of the pull flanges 23 between the ends of which the separation extensions extend. In a preferred arrangement the pull flanges have their ends sealed together as shown at 19*a*.

For connecting the bags 15 together in series, connecting strips 35 of the bag wall web material connect the tops of the pull flanges 23 and extend solidily continuously along the length of the ribbon of connected bags to a desirable width above the upper ends of the separation extensions 34. The width of the connecting strips 35 together with the relative mass of the guide ribs 28 is such as to maintain the individual bag sections 15 in a stable connected relation for filling manipulation.

In the filling station the bags 15 are guided seriatim into a filling position by means of the guide ribs 28, 28′, 28″, 31, or 32, as the case may be, and are opened, filled, and then moved from the filling station. The connecting strips are then removed below or along the tops of the separation extension 34, with the zipper 20 of each bag which had been opened for filling being closed, and the separated filled bag 15 removed from the series. To this end, the guide ribs 28 are threaded through complementary dovetail guideways 37 of combination supporting and bag opening jaws 38 (FIGS. 5, 11 and 12). These jaws 38 may be mounted on reciprocating guides 39 connected by means of respective cranks 40 to respective links 41. The links 41 are connected to means such as a foot operated treadle 42, so that by operating the treadle 42 the jaws 38 can be moved apart from the closed position in FIG. 12 in opposition to biasing means such as springs 43.

For filling the bags 15, each successive bag may be pulled into filling position such as by manually grasping the lead bag in the series and pulling it to slidably advance the ribs 28 through the jaws 38. When each successive bag 15 is in the filling position, the jaws 38 which normally are biased toward one another as shown in FIG. 12, are pulled apart by operation of the treadle 42 into separated position as shown in FIG. 11. Thereby the jaws 38 pull the connecting strips 35 apart at the top of the bag 15 that is to be filled so that through the strips 35 the separating pull of the jaws 38 is passed on to the pull flanges 23 and causes the profiles 21 and 22 of the zipper 20 of the affected bag 15 to open. To further improve the pulling force of the jaws 38, it is focused between the sealed ends 19*a* of the affected pull flanges 23. Contents may then be loaded into the top opened bag in any desirable manner. After the contents have been filled into the bag, the series of bags is pulled onward to advance another bag 15 into filling position.

As the filled bag is pulled away from the filling station, the connecting strips 35 are separated from the filled bag, such as by means of a sharp instrument 44, i.e. a knife blade, which may be stationarily mounted in proper shearing position on the frame of the apparatus.

Before or after the cut off knife 44, but preferably immediately before, the zipper 20 is closed by means for pressing the profiles 21 and 22 together. In one form such means may comprise pinch rollers 45 mounted rotatably on stub shafts 47 and having respective grooves 48 for receiving the zipper 20 therebetween for not only closing the zipper, but also supporting the bag which is engaged between the rollers 45 against sagging away from the cut off member 44. If necessary a second set of rollers may be provided for the purpose of supporting the bag.

It will be observed that the cut-off member 44 is located to separate the strips 35 from the tops of the pull flanges 23 in line with or just below the top ends of the separation extensions 34. The filled bag is not fully separated from the connecting strips 35 until the preceeding bag has been filled. Thereupon, by pulling on the filled bag or on the partially severed strips 35 as indicated by the directional arrow 49, the previously filled bag is advanced completely past the cut-off member 44 and thus entirely separated from the series of bags, while at the same time the next filled bag is advanced for cutoff by the cut-off member 44 and closure of the zipper 20 by the rollers 45. Each bag advancing maneuver is facilitated by the indexing advantage afforded by the filling station mechanisms.

It will thus be apparent that the filling, bag separating and zipper closing apparatus can be operated easily and efficiently by advancing the successive bags one at a time by one minipulating hand while the other hand is used for filling the bag which is in position and which is opened by operating the foot treadle to open the bag supporting and opening jaws. Relatively unskilled persons can quickly learn and easily operate the apparatus, which can be inexpensively produced.

The different forms of the guide ribs 28', 28'', 31, 32 in FIGS. 6–9, can be readily accommodated in simple modifications of the shoes or jaws 38 to provide complementary and properly positioned tracks for the respective ribs. If desired the shoe jaws may be modified to accept all or at least a number of the various rib forms in one jaw configuration.

Figure 8:
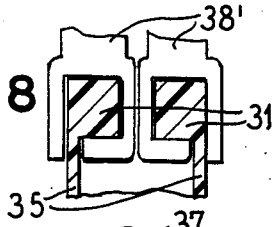
FIG. 8 shows a further modification.
Figure 9:
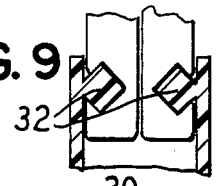
FIG. 9 shows another modification.
Figure 10:
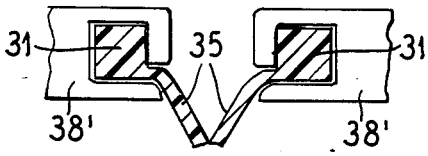
FIG. 10 shows still another modification.

In FIG. 10 the jaws 38' are substantially the same as the jaws 38' in FIG. 8 but so positioned that the connecting strips 35 are maneuvered into a generally horizontal direction away from one another, thus affording more head room, where that is a consideration.

It will be understood that variations and modifications may be effected without departing from the spirit and scope of the novel concepts of the present invention.

I claim as my invention:

1. Integrally serially connected top fillable bags wherein each bag has closed bottom and side edges and reclosable zipper means extending across the top of each bag with upstanding front and rear pull flanges extending above said zipper means, and comprising:

said bags being partially separated by slots along their adjacent sides, the slots extending from said pull flanges continuously a substantial distance down past the zipper means so that adjacent bags are freely separate at the location of the zipper means and a lateral pull on one bag is not translated to an adjacent bag at the zipper means;

respective continuous strips integrally connecting the tops of the front and rear pull flanges of all of said bags and thereby connecting the bags in a continuous series;

said connecting strips having protruding guide ribs extending continuously along their upper edge portions for supporting the connected bags, so that the connected bags can be slidably drawn through supporting jaws serving also as bag top filling separators; and said strips being removable from the tops of said pull flanges so that the bags are separated from one another by virtue of said slots upon removal of said strips.

2. Connected fillable bags according to claim 1, wherein the ends of said pull flanges of each bag are secured together at said slots, and said secured pull flange ends remaining secured after removal of said strips.

3. Connected fillable bags according to claim 1, wherein said ribs are on the inside of said upper edge portions of said connecting strips.

4. Connected bags according to claim 1, wherein said ribs are on the top edges of said connecting strips and have narrow projecting spacers extending upwardly therefrom.

5. Connected bags according to claim 1, wherein said ribs are on the outer sides of said strips.

6. Connected bags according to claim 1, wherein said ribs are of generally T-shape.

7. Connected bags according toclaim 1, wherein said ribs are of square cross-section.

8. Connected bags according to claim 1, wherein said ribs are of generally diamond shape cross-section and have one of the corners thereof connected to the attached connecting strip.

9. A method of filling and separating top fillable serially conected bags which are closed along their bottom and sides and have reclosable zippers along their upper end portions with front and rear pull flanges extending above the zippers, the bags being partially separated from one another along their adjacent sides by separations, which extend upwardly past said zippers and to the tops of the pull flanges and between the ends of the pull flanges, there being respective continuous integral strips connecting said tops of said front and rear pull flanges and thereby connecting the bags to one another in series, the upper portions of the connecting strips having cohtinuous protruding guide ribs therealong for supporting the connected bags, the method comprising:

slidably engaging said ribs in supporting and separating jaw means at a filling station;

relatively sliding said ribs in said jaw means and thereby moving and aligning said bags seriatim into said filling station;

as each bag is in the filling station effecting separation of said pull flanges by means of said jaw means and thereby opening the top of the bag by pulling said zipper of the bag open;

filling contents into the bags in the filling station;

advancing the connected bags and thereby moving the filled bag away from the filling station and advancing a succeeding bag into the filling station for opening and filling;

closing the zipper of the filled bag;

and separating the connecting strips from the tops of the pull flanges of the filled bag at a level at or below the top of said separations to sepatate the filled bag from the remaining connected bags.

10. A method according to claim 9, which comprises operating said jaw means by actuating a foot treadle.

11. A method according to claim 9, which comprises pulling said filled bag past a cut-off knife and thereby effecting said separating of the connecting strip from the tops of the pull flanges.

12. A method according to claim 9, which comprises pulling said filled bag through zipper closing means.

13. A method according to claim 9, which comprises operating said jaw means by actuating a foot treadle, pulling said filled bag past a cut-off knife and thereby effecting said separating of the connecting strip from the tops of the pull flanges, and pulling said filled bag through zipper closing means.

14. Apparatus for filling and separating serially connected top fillable bags which are closed along their bottom and sides and have reclosable zippers along their upper end portions with front and rear pull flanges extending above the zippers, the bags being separated from one another along their adjacent sides by separations which extend upwardly past the zippers and to the tops of the pull flanges and between the ends of the pull flanges, there being respective continuous integral strips connecting said front and rear pull flanges and thereby connecting said tops of the bags to one another, the upper portions of the connecting strips having continuous protruding guide ribs therealong for supporting the connected bags, the apparatus comprising:

means providing a bag filling station including supporting and separating jaws for slidably engaging said ribs for movement of said bags along said jaws and aligning said bags seriatim in said filling station;

said jaws including means for separating said pull flanges and thereby said zipper of each bag in the filling station to open the top of the bag for receiving contents into the bag;

means moving the filled bag from the filling station and advancing a succeeding bag into the filling station for opening and filling of the succeeding bag;

means for closing the zipper of the filled bag; and means for separating the connecting strips from the tops of the pull flanges of the filled bag at a level at or below the top of said separations to separate the filled bag from the remaining connected bags.

15. Apparatus according to claim 14, wherein said jaws are mounted for relatively reciprocating toward and away from one another, and means for effecting reciprocation of said jaws.

16. Apparatus according to claim 15, including means for normally biasing said jaws toward one another.

17. Apparatus according to claim 16, including a foot operated treadle and linkage means operatively connected to said treadle and to said jaws.

18. Apparatus according to claim 14, wherein said jaws comprise block members having tracks within which said guide ribs are received.

19. Apparatus according to claim 14, wherein said separating means comprises a stationery knife past which the filled bag is pulled for severing and separating the connecting strips from filled bag.

20. Apparatus according to claim 14, wherein said means for closing comprises pinch rollers between which the upper portion of the filled bag is pulled and which have means for supporting the filled bag.

* * * * *